US005295795A

United States Patent [19]

Yasuda et al.

[11] Patent Number: 5,295,795

[45] Date of Patent: Mar. 22, 1994

[54] HYDRAULIC DRIVE SYSTEM FOR CONSTRUCTION MACHINE

[75] Inventors: Tomohiko Yasuda, Kashiwa; Yukio Aoyagi, Ibaraki, both of Japan

[73] Assignee: Hitachi Construction Machinery Co., Ltd., Tokyo, Japan

[21] Appl. No.: 930,553

[22] PCT Filed: Apr. 13, 1992

[86] PCT No.: PCT/JP92/00463

§ 371 Date: Sep. 29, 1992

§ 102(e) Date: Sep. 29, 1992

[87] PCT Pub. No.: WO92/18710

PCT Pub. Date: Oct. 29, 1992

[30] Foreign Application Priority Data

Apr. 12, 1991 [JP] Japan ..... 3-106574

[51] Int. Cl.[5] ..... F04B 49/00

[52] U.S. Cl. ..... 417/213; 417/222.2; 417/270; 60/368; 60/445

[58] Field of Search ..... 417/213, 222.2, 270; 60/368, 445, 450

[56] References Cited

U.S. PATENT DOCUMENTS 4,600,364 7/1986 Nakatani et al. ..... 417/222.2
5,073,091 12/1991 Burgess et al. ..... 417/270
5,077,973 1/1992 Suzuki et al. ..... 60/368

*Primary Examiner*—Richard A. Berisch
*Assistant Examiner*—David W. Scheuermann
*Attorney, Agent, or Firm*—Fay, Sharpe, Beall, Fagan, Minnich & McKee

[57] ABSTRACT

A hydraulic drive system for a construction machine comprising a hydraulic pump (1) of variable displacement type, a pump regulator (2) for controlling a delivery rate of the hydraulic pump, a plurality of hydraulic actuators (7) driven by a hydraulic fluid supplied from the hydraulic pump, a plurality of directional control valves (4A–4D) for controlling respective flows of the hydraulic fluid supplied from the hydraulic pump to the plural hydraulic actuators, a low-pressure circuit (22), a center bypass line (23) for connecting in series center bypasses of the plural directional control valves (4A–4D) to the low-pressure circuit (22), a plurality of bleeding-off restrictors (26) in the center bypass line and having their openings variable in accordance with respectively associated directional control valves, a fixed restrictor (5) disposed in the center bypass line for producing a control pressure (PZ), and a pressure sensor (8) for detecting the control pressure and outputting a corresponding electric signal (E). The hydraulic drive system further comprises a memory unit (**9*c*) for storing a plurality of preset pump flow rate characteristics (40, 41, 42) that define relationships between a value of the electric signal (E) outputted from the pressure sensor (8) and a delivery rate (Q) of the hydraulic pump (1), a selector (12) for outputting a command signal (ES) to select one of the plural pump flow rate characteristics (40, 41, 42) preset in the memory unit, and an arithmetic unit (9*b*) for determining the delivery rate (Q) corresponding to the value of the electric signal (E) outputted from the pressure sensor means (8**) based on the pump flow rate characteristic selected by the command signal (ES), and outputting a drive signal (ED) corresponding to the determined delivery rate. The pump regulator is driven with the drive signal.

5 Claims, 12 Drawing Sheets

HYDRAULIC DRIVE SYSTEM FOR CONSTRUCTION MACHINE

TECHNICAL FIELD

The present invention relates to a hydraulic drive system for construction machines such as hydraulic excavators, and more particularly to a hydraulic drive system for construction machines for controlling a delivery rate of a hydraulic pump dependent upon a control pressure produced by a flow resistive element.

BACKGROUND OF THE INVENTION

A conventional hydraulic drive system for construction machines comprises, as disclosed in JP, A, 1-25921, a hydraulic pump of variable displacement type, a pump regulator for controlling a delivery rate of the hydraulic pump, a plurality of hydraulic actuators driven by a hydraulic fluid supplied from the hydraulic pump, a plurality of directional control valves of center bypass type for controlling respective flows of the hydraulic fluid supplied from the hydraulic pump to the plural hydraulic actuators, a center bypass line for connecting in series center bypasses of the plural directional control valves to a reservoir, a flow resistive element, e.g., a fixed restrictor, disposed in a downstream portion of the center bypass line for producing a control pressure, a pressure sensor for detecting the control pressure produced by the fixed restrictor and outputting a corresponding electric signal, and a function generator for storing preset one kind of pump flow rate characteristic that defines the relationship between a value of the electric signal outputted from the pressure sensor and a delivery rate of the hydraulic pump, determining the delivery rate corresponding to the value of the electric signal outputted from the pressure sensor based on the preset pump flow rate characteristic, and outputting, as a drive signal, a signal corresponding to the determined delivery rate. The pump regulator is driven with the drive signal.

In the above prior art, a variable restrictor for bleeding-off is disposed in the center bypass of each of the plural directional control valves. This variable restrictor is fully opened when the associated directional control valve is at its neutral position, and its opening is reduced as an input amount of the directional control valve increases. As a result, with the directional control valve being at its neutral position, the flow rate of the hydraulic fluid passing through the center bypass is maximized and, therefore, the control pressure produced by the fixed restrictor is also maximized. Then, as the input amount of the directional control valve increases, the flow rate through the center bypass is reduced and so is the control pressure. The pump flow rate characteristic preset in the function generator is set such that the delivery rate of the hydraulic pump is increased with the control pressure becoming smaller. Accordingly, the delivery rate of the hydraulic pump is controlled to increase dependent upon the input amount of the directional control valve.

Meanwhile, there are various kinds of operations to be performed by construction machines such as hydraulic excavators, and the directional control valve requires control characteristics different from each other dependent upon the kinds of operations. For example, in the work such as craning which requires fine operation, a control characteristic superior in the metering property is needed. On the other hand, in the work such as digging which requires powerful operation, a control characteristic superior in rising of the metering property and capable of easily supplying the hydraulic fluid at a large rate is needed.

In the conventional hydraulic drive system as stated above, however, the control characteristic of the delivery rate of the hydraulic pump is uniquely determined dependent upon the setting in the function generator and, correspondingly, the control characteristic of the directional control valve is also uniquely determined. This has raised the problem that good operating efficiency cannot be ensured in other kinds of work than particular one.

More specifically, in the above-explained prior hydraulic drive system, the control characteristic of the directional control valve is determined dependent upon the setting of the function generator as follows. When one directional control valve is operated, for example, the delivery rate of the hydraulic pump is controlled dependent upon the setting of the function generator as mentioned above, and the hydraulic fluid is supplied to the directional control valve at the controlled flow rate. The directional control valve supplies the hydraulic fluid to the actuator therethrough at a flow rate resulted by subtracting, from the pump delivery rate, the flow rate of the hydraulic fluid flowing out through the bleeding-off variable restrictor (i.e., the flow rate through the center bypass), dependent upon the opening area of the bleeding-off variable restrictor which is determined by the input amount (i.e., stroke) of the directional control valve at that time. In this case, because the control characteristic of the delivery rate of the hydraulic pump with respect to the valve stroke is fixed and the opening characteristic of the bleeding-off variable restrictor with respect to the valve stroke is also fixed, the control characteristic of the directional control valve, such as a metering characteristic, with respect to the flow rate of the hydraulic fluid supplied to the actuator becomes fixed.

Accordingly, when the pump flow rate characteristic preset in the function generator is set to give a control characteristic suitable for the work such as digging, for example, which requires powerful operation, it is difficult to perform fine operation in the work such as craning, for example, which requires fine operation. On the contrary, when the pump flow rate characteristic preset in the function generator is set to give a control characteristic suitable for the work such as craning, for example, which requires fine operation, the machine operates too slow to efficiently perform the work such as digging, for example, which requires powerful operation.

An object of the present invention is to provide a hydraulic drive system for construction machines in which the flow rate characteristic of a hydraulic pump can be changed to make the control characteristic of a directional control valve variable, thereby ensuring good operating efficiency for plural different kinds of work.

DISCLOSURE OF THE INVENTION

To achieve the above object, according to the present invention, there is provided a hydraulic drive system for a construction machine comprising a hydraulic pump of variable displacement type, a pump regulator for controlling a delivery rate of said hydraulic pump, a plurality of hydraulic actuators driven by a hydraulic fluid supplied from said hydraulic pump, a plurality of directional control valves for controlling respective flows of the hydraulic fluid supplied from said hydraulic pump to said plural hydraulic actuators, a low-pressure circuit, a center bypass line for connecting in series center bypasses of said plural directional control valves to said low-pressure circuit, a plurality of bleeding-off restrictor means disposed in said center bypass line and having their openings variable in accordance with the associated directional control valves, respectively, flow resistive means disposed in said center bypass line for producing a control pressure, and pressure sensor means for detecting said control pressure and outputting a corresponding electric signal, wherein a drive signal of said pump regulator is given dependent upon the electric signal outputted from said pressure sensor means and said pump regulator is driven with said drive signal, said hydraulic drive system further comprising (a) memory means for storing a plurality of preset pump flow rate characteristics that define relationships between a value of the electric signal outputted from said pressure sensor means and a delivery rate of said hydraulic pump; (b) selector means for outputting a command signal to select one of the plural pump flow rate characteristics preset in said memory means; and (c) arithmetic means for determining the delivery rate corresponding to the value of the electric signal outputted from said pressure sensor means based on the pump flow rate characteristic selected by said command signal, and outputting, as said drive signal, a signal corresponding to the determined delivery rate.

With the hydraulic drive system of the present invention thus arranged, the plural pump flow rate characteristics are preset in the memory means, one of these characteristics is selected in response to the command signal outputted from the select means, and the delivery rate of the hydraulic pump is controlled using the selected pump flow rate characteristic. By changing the pump flow rate characteristic, therefore, respective control characteristics of the directional control valves can be varied correspondingly, making it possible to vary the control characteristics of the associated directional control valves dependent upon the intended work schedule and ensure good operating efficiency for plural types of work different from each other.

Preferably, the memory means and the arithmetic means are constituted by a microcomputer, and the selector means is a manual selector for outputting the command signal to the microcomputer.

Also preferably, the pressure sensor means is means for detecting a pressure upstream of the flow resistive means. The pressure sensor means may be means for detecting a differential pressure across the flow resistive means.

Further preferably, the plural pump flow rate characteristics preset in the memory means include plural groups of maximum and minimum setting values, and one of these plural groups of setting values is selected in response to the command signal outputted from the selector means.

With the minimum value of the pump flow rate characteristic being smaller, the minimum delivery rate of the hydraulic pump is reduced to enable economical operation with less energy loss. With the maximum value of the pump flow rate characteristic being larger, the maximum delivery rate of the hydraulic pump is increased to enable the hydraulic fluid to be supplied to the actuator at a larger flow rate for enlarging the power of operation. In addition, with a deviation between the maximum and minimum values of the pump delivery rate being smaller, a change rate of the pump delivery rate is reduced to provide the superior metering property at the directional control valve. With the deviation therebetween being larger, the change rate of the pump delivery rate is increased to provide superior rising in the metering property at the directional control valve. Accordingly, by preparing plural groups of maximum and minimum values for the pump flow rate characteristic and selecting one of those groups on demand, the flow rate characteristic of the hydraulic pump can be optionally set to realize a desired control characteristic of the directional control valve.

BEST MODE FOR CARRYING OUT THE INVENTION

Preferred embodiments of the present invention will be hereinafter with reference to the drawings. In these embodiments, the present invention is applied to a hydraulic drive system for hydraulic excavators.

To begin with, a first embodiment of the present invention will be explained by referring to FIGS. 1 to 12.

Figure 1:
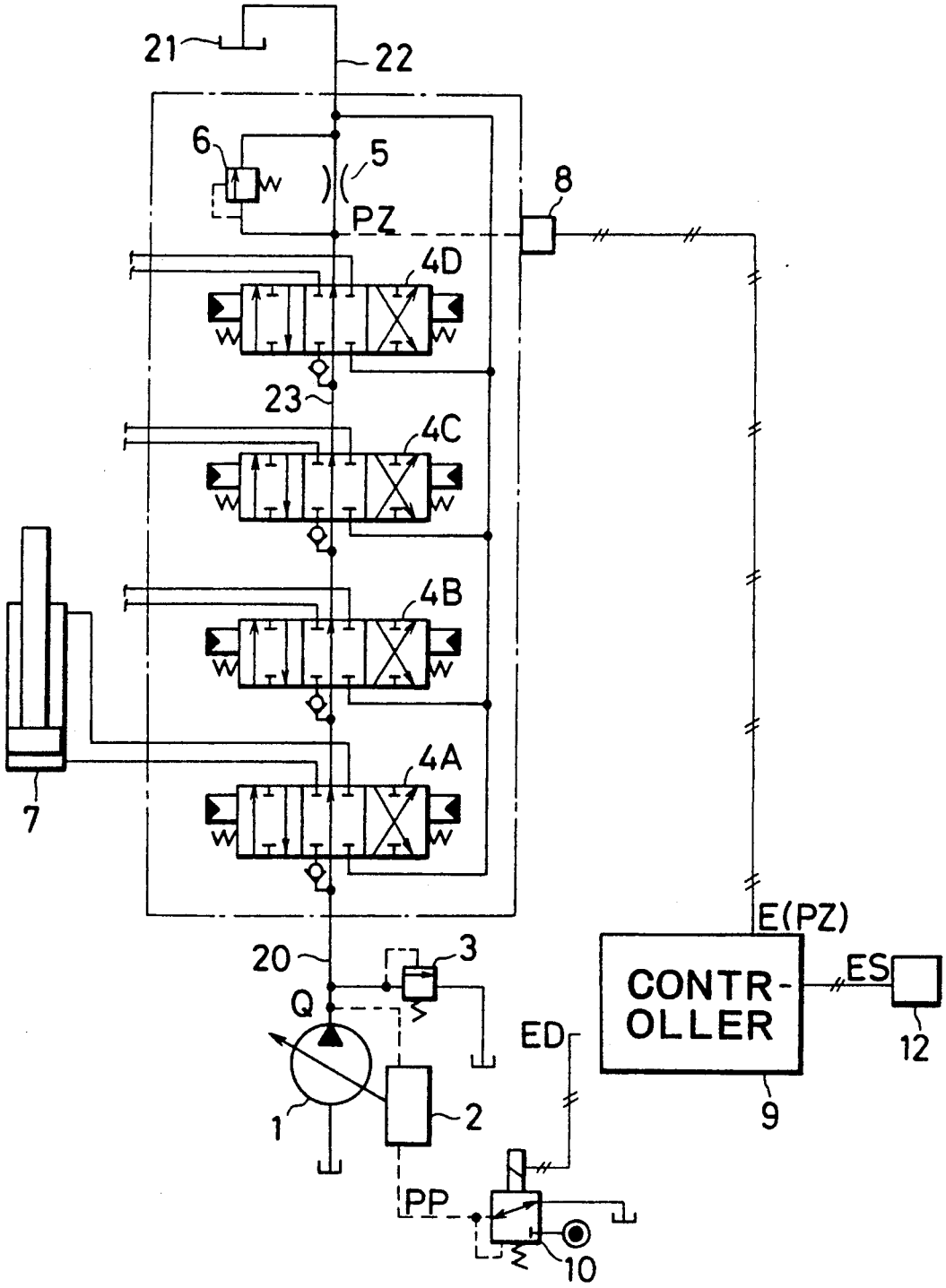
FIG. 1 is a circuit diagram showing a hydraulic drive system for construction machines according to a first embodiment of the present invention.

In FIG. 1, the hydraulic drive system of the present invention comprises a hydraulic pump 1 of variable displacement type, a pump regulator 2 for controlling a delivery rate of the hydraulic pump 1, a plurality of hydraulic actuators, including actuators 7 such as a boom cylinder and an arm cylinder, driven by a hydraulic fluid supplied from the hydraulic pump 1, a plurality of directional control valves 4A, 4B, 4C, 4D of center bypass type for controlling respective flows of the hydraulic fluid supplied from the hydraulic pump to the plural hydraulic actuators, a center bypass line 23 connected to a delivery line 20 of the hydraulic pump 1 and connecting in series center bypasses of the plural directional control valves 4A, 4B, 4C, 4D to a low-pressure circuit 22, the circuit 22 including a reservoir 21 in series, a fixed restrictor 5 disposed in a most downstream portion of the center bypass line 23 for producing a control pressure, a main relief valve 3 for controlling a maximum pressure in the delivery line 20, and a surge cutting relief valve 6 which is operated when the hydraulic fluid flows through the center bypass line 23 at a large flow rate.

The hydraulic drive system of this embodiment also comprises a pressure sensor 8 for detecting a control pressure PZ produced upstream of the fixed restrictor 5 and outputting a corresponding electric signal E(PZ), a controller 9 for storing a plurality of preset pump flow rate characteristics that define the relationships between a value of the electric signal E(PZ) outputted from the pressure sensor 8 and a delivery rate Q of the hydraulic pump 1, determining the delivery rate Q corresponding to the value of the electric signal E(PZ) outputted from the pressure sensor 8 based on the preset pump flow rate characteristic, and outputting a drive signal ED corresponding to the determined delivery rate Q, a selector 12 manually operated to output a command signal ES for selecting one of the plural pump flow rate characteristics preset in the controller 9, and a solenoid valve 10 driven with the drive signal ED outputted from the controller 9. The regulator 2 is driven with a drive pressure PP outputted from the solenoid valve 10.

Figure 2:
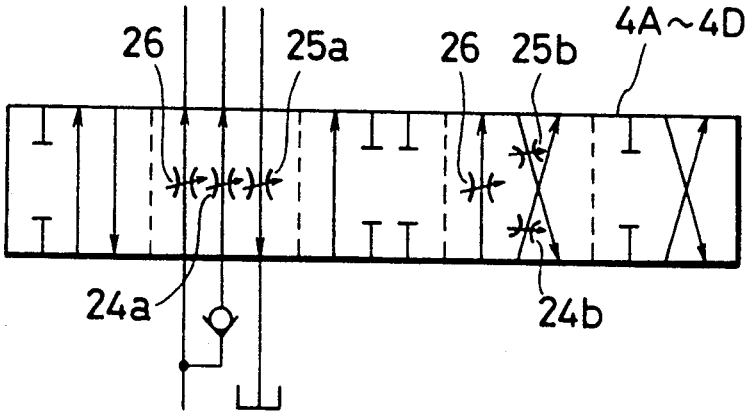
FIG. 2 is an explanatory view showing transient positions of each directional control valve shown in FIG. 1.
Figure 3:
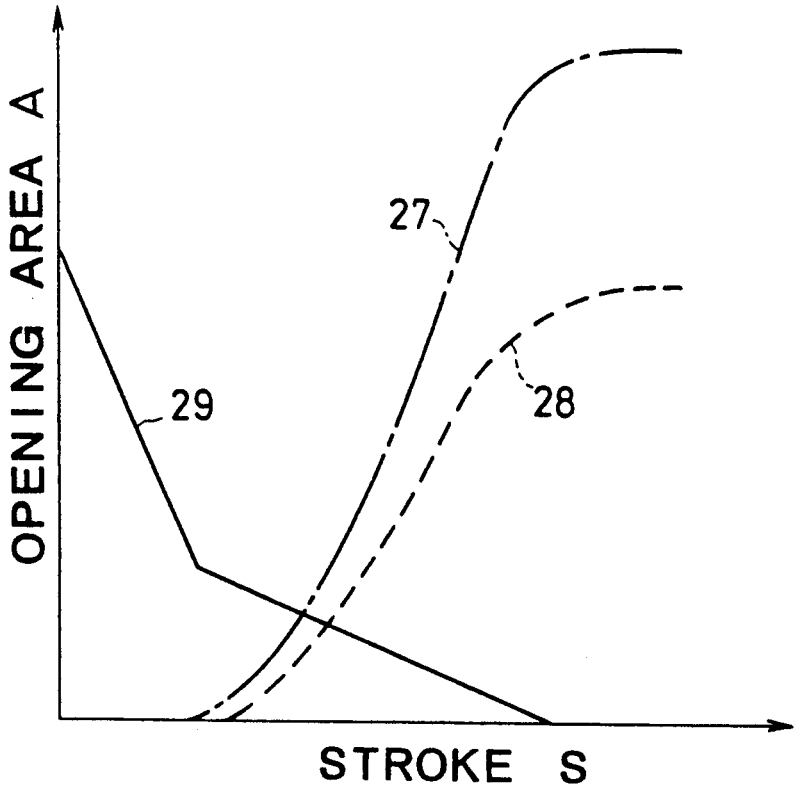
FIG. 3 is a graph showing opening characteristics of a variable restrictor for bleeding-off, a meter-in variable restrictor and a meter-out variable restrictor with respect to a stroke of the directional control valve shown in FIG. 1.

In the above arrangement, the plural directional control valves 4A, 4B, 4C, 4D are each, as shown in FIG. 2, formed with meter-in variable restrictors 24*a*, 24*b* (hereinafter represented by 24) and meter-out variable restrictors 25*a*, 25*b* (hereinafter represented by 25), and also provided in its center bypass with a variable restrictor 26 for bleeding-off. FIG. 3 shows the relationships between a valve stroke S and respective opening areas A of the meter-in variable restrictor 24, the meter-out variable restrictor 25 and the bleeding-off variable restrictor 26. More specifically, in FIG. 3, 27 and 28 indicate characteristics of the opening areas of the meter-in variable restrictor 24 and the meter-out variable restrictor 25, respectively, and 29 indicates a characteristic of the opening area of the bleeding-off variable restrictor 25. The meter-in variable restrictor 24 and the meter-out variable restrictor 25 are fully closed when the valve stroke is zero (i.e., when the directional control valve is at its neutral position), and their opening areas are increased as the valve stroke increases. On the other hand, the bleeding-off variable restrictor 26 is fully opened when the valve stroke is zero, and its opening area is reduced as the valve stroke increases. By so setting the opening characteristic of the bleeding-off variable restrictor 26, when the directional control valve is at its neutral position, for example, the flow rate of the hydraulic fluid flowing through the center bypass (i.e., the flow rate through the center bypass) is maximized and the control pressure produced by the fixed restrictor is also maximized. As an input amount of the directional control valve 4A increases, the flow rate through the center bypass is reduced and so is the control pressure. Meanwhile, during normal operation in which the hydraulic fluid is supplied to the actuator 7 for driving it, the actuator 7 is supplied with the hydraulic fluid at a flow rate resulted by subtracting, from the pump delivery rate, the flow rate of the hydraulic fluid flowing out through the bleeding-off variable restrictor 26 (i.e., the flow rate through the center bypass). Therefore, the control characteristic of the directional control valve with respect to the flow rate of the hydraulic fluid supplied to the actuator 7 is determined by the opening characteristic of the bleeding-off variable restrictor 26 and the flow rate characteristic of the hydraulic pump 1.

Figure 4:
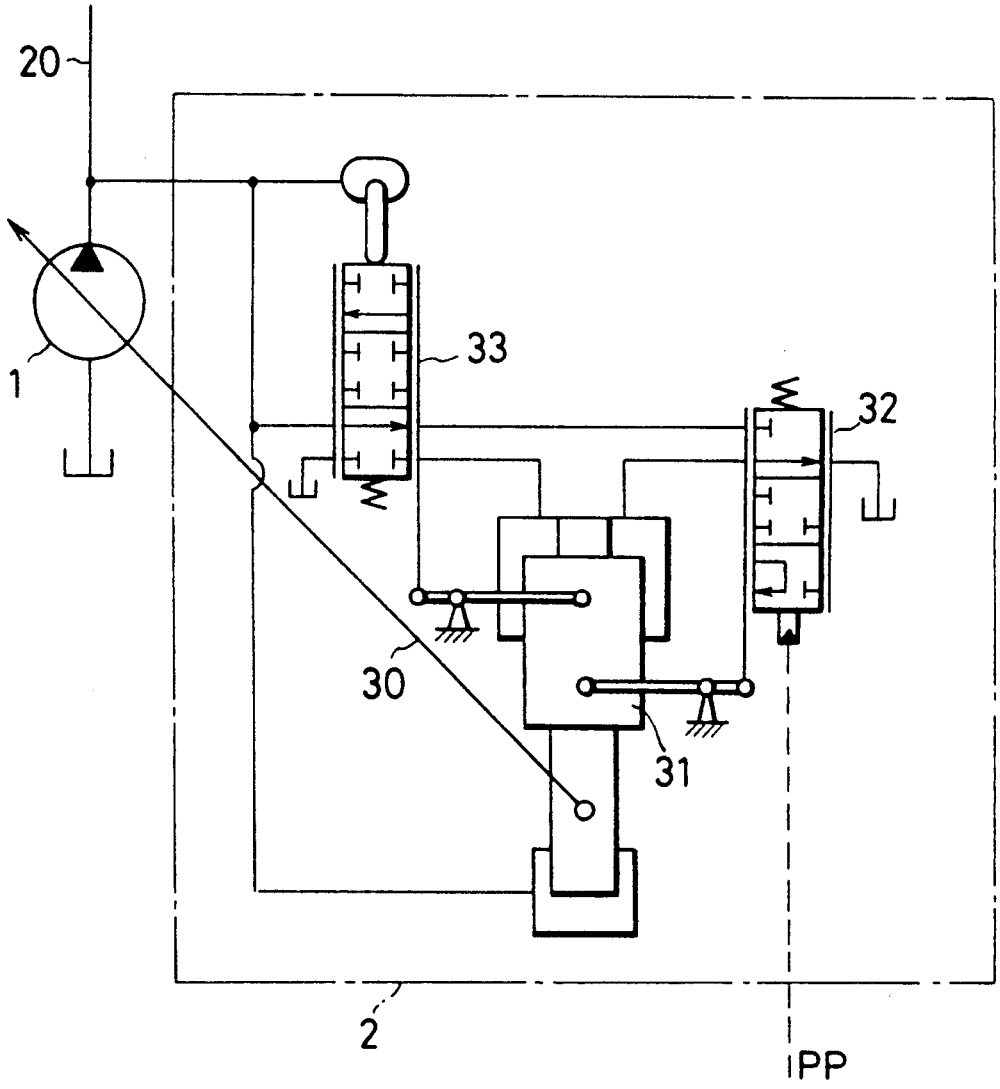
FIG. 4 is a circuit diagram showing details of a pump regulator shown in FIG. 1.

The pump regulator 2 comprises, as shown in FIG. 4, a piston/cylinder unit 31 for driving a displacement volume varying member of the hydraulic pump 1, e.g., a swash plate 30, a first servo valve 32 responsive to the drive pressure PP outputted from the solenoid valve 10 for adjusting the flow rate of the hydraulic fluid supplied to the piston/cylinder unit 31 and controlling a tilting amount of the swash plate of the hydraulic pump 1, and a second servo valve 33 responsive to the pump delivery pressure for adjusting the flow rate of the hydraulic fluid supplied to the piston/cylinder unit 31 and controlling a tilting amount of the swash plate of the hydraulic pump 1 in order to limit an input torque.

Figure 5:
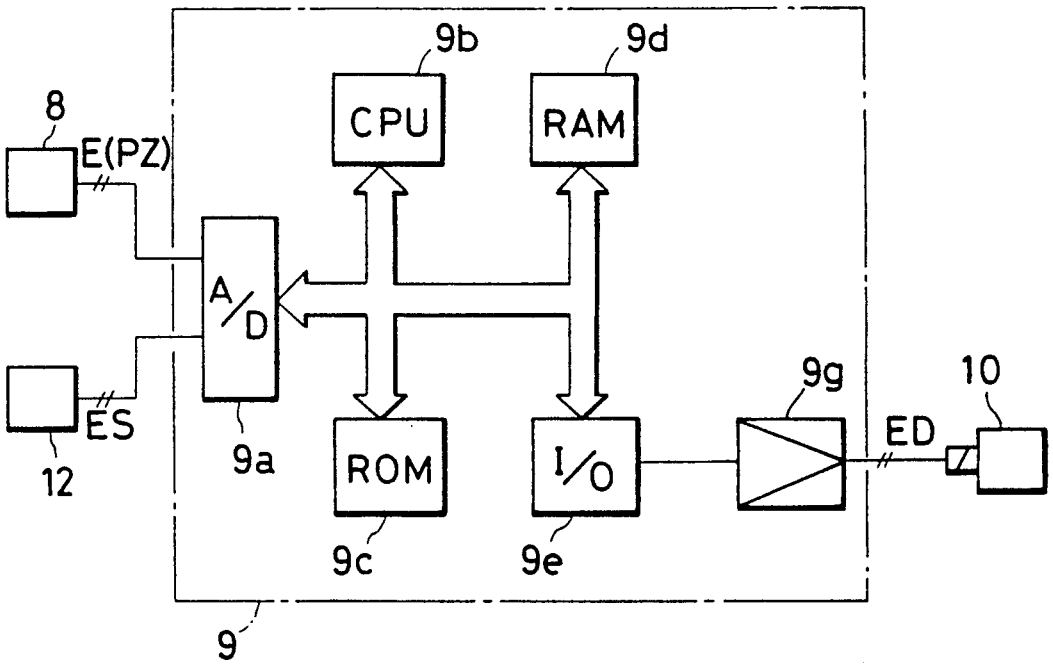
FIG. 5 is a block diagram showing a hardware arrangement of a controller shown in FIG. 1.

The controller 9 is constituted by a microcomputer and comprises, as shown in FIG. 5, an A/D converter 9*a* for converting the electric signal E(PZ) outputted from the pressure sensor 8 and the command signal ES outputted from the selector 12 into digital signals, a central processing unit (CPU) 9*b*, a read only memory (ROM) 9*c* for storing the plurality of aforesaid pump flow rate characteristics and a program of control procedures therein, a random access memory (RAM) 9*d* for temporarily storing numerical values under calculation therein, an I/O interface 9*e* for outputting the drive signal, and an amplifier 9*g* connected to the solenoid valve 10.

Figure 6:
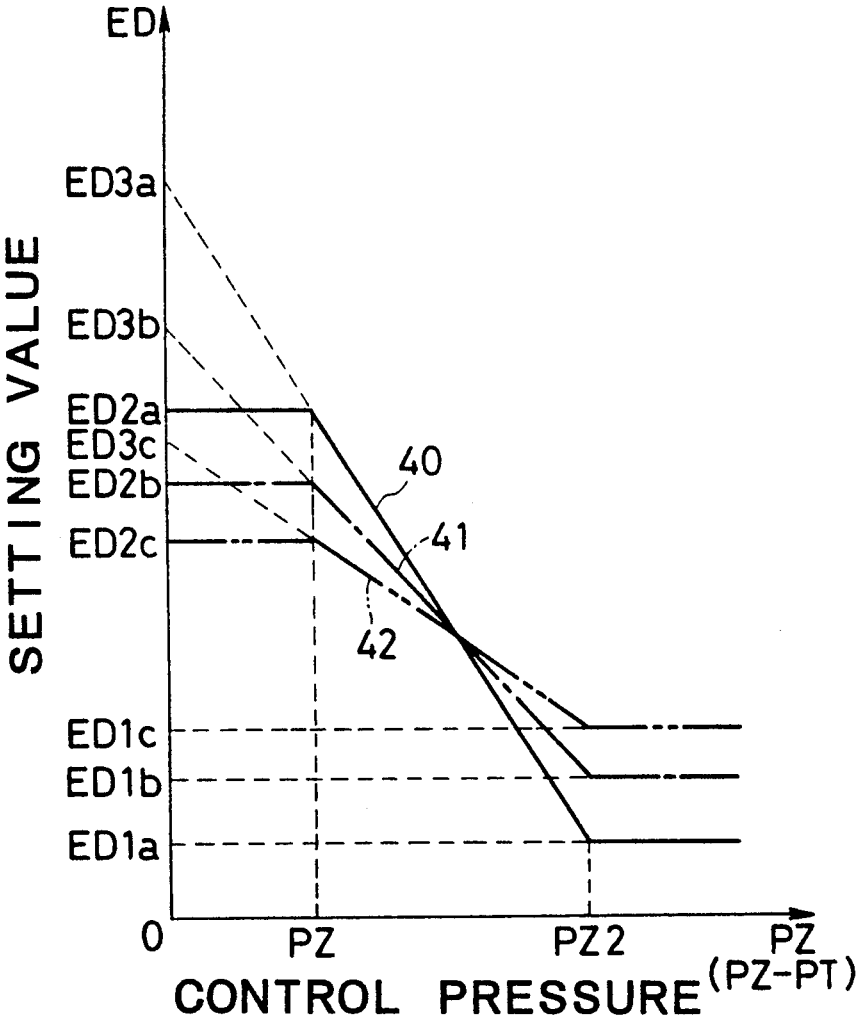
FIG. 6 is a graph showing a plurality of pump flow rate characteristics previously stored in a ROM shown in FIG. 5.

The plurality of pump flow rate characteristics preset in the ROM 9*c* include a first pump flow rate characteristic 40, a second pump flow rate characteristic 41 and a third pump flow rate characteristic 42 as shown in FIG. 6.

The first pump flow rate characteristic 40 is set to output the drive signal ED of a first minimum value ED1a when the control pressure PZ is larger than a limit value PZ2, output the drive signal ED of a first maximum value ED2a when the control pressure PZ is smaller than a limit value PZ1, and further output the drive signal ED given by calculation of:

$$ED = -\{(ED2a - ED1a)/(PZ2 - PZ1)\} \cdot PZ + ED3a \quad (1)$$

when the control pressure PZ is between PZ1 and PZ2. Note that ED3a in Equation (1) is a first auxiliary used to calculate a value between the first minimum value ED1a and the first maximum value ED2a.

The second pump flow rate characteristic 41 is set to output the drive signal ED of a second minimum value ED1b (>ED1a) when the control pressure PZ is larger than the limit value PZ2, output the drive signal ED of a second maximum value ED2b (<ED2a) when the control pressure PZ is smaller than the limit value PZ1, and further output the drive signal ED given by calculation of:

$$ED = -\{(ED2b - ED1b)/(PZ2 - PZ1)\} \cdot PZ + ED3b \quad (2)$$

when the control pressure PZ is between PZ1 and PZ2. Note that ED3b in Equation (2) is a second auxiliary used to calculate a value between the second minimum value ED1b and the second maximum value ED2b.

The third pump flow rate characteristic 42 is set to output the drive signal ED of a third minimum value ED1c (>ED1b) when the control pressure PZ is larger than the limit value PZ1, output the drive signal ED of a third maximum value ED2c (<ED2b) when the control pressure PZ is smaller than the limit value PZ1, and further output the drive signal ED given by calculation of:

$$ED = -\{(ED2c - ED1c)/(PZ2 - PZ1)\} \cdot PZ + ED3c \quad (3)$$

when the control pressure PZ is between PZ1 and PZ2. Note that ED3c in Equation (3) is a third auxiliary used to calculate a value between the third minimum value ED1c and the third maximum value ED2c.

As mentioned above, the first to third pump flow rate characteristics 40 to 42 are respectively defined by three sets groups of setting values: i.e., the first minimum value ED1a, the first maximum value ED2a and the first auxiliary ED3a; the second minimum value ED1b, the second maximum value ED2b and the second auxiliary ED3b; and the third minimum value ED1c, the third maximum value ED2c and the third auxiliary ED3c.

The first to third minimum values ED1a, ED1b, ED1c are each a setting value to give a minimum delivery rate of the hydraulic pump 1. With this value being smaller, the minimum delivery rate is reduced to enable economical operation with smaller energy loss. The first to third maximum values ED2a, ED2b, ED2c are each a setting value to give a maximum delivery rate of the hydraulic pump 1. With this value being larger, as described later, the hydraulic fluid can be supplied to the actuator at a larger flow rate to increase the power of operation. Further, a deviation between the maximum value and the minimum value is an index which determines a slope of each characteristic line shown in FIG. 6. The smaller the slope, the smaller will be a change rate of the pump delivery rate, resulting in the improved metering property at the directional control valve, as described later. The larger the slope, the larger will be a change rate of the pump delivery rate, resulting in improved rising of the metering property at the directional control valve.

Figure 7:
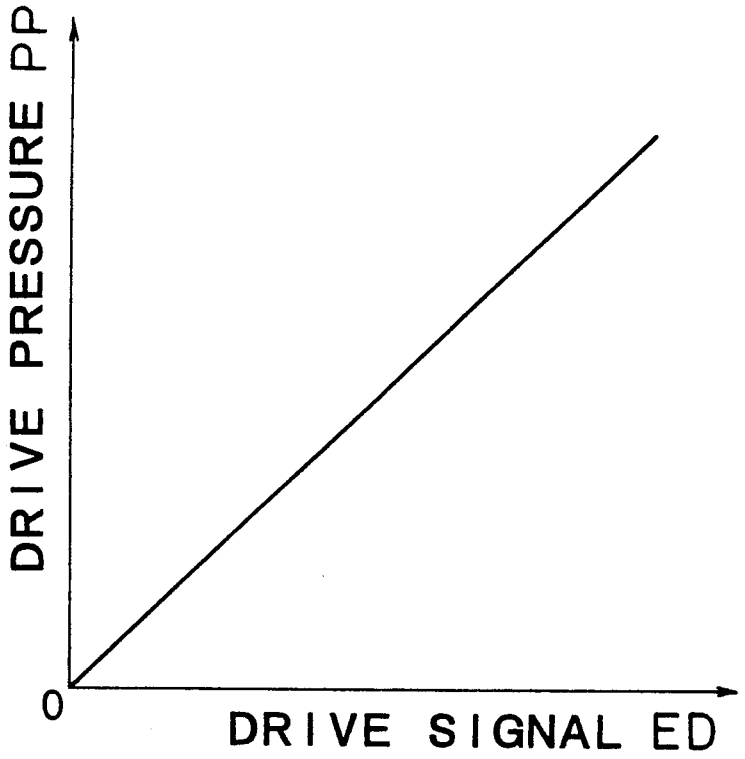
FIG. 7 is a graph showing the relationship between a drive signal inputted to a solenoid valve shown in FIG. 1 and a drive force outputted from the solenoid valve.
Figure 8:
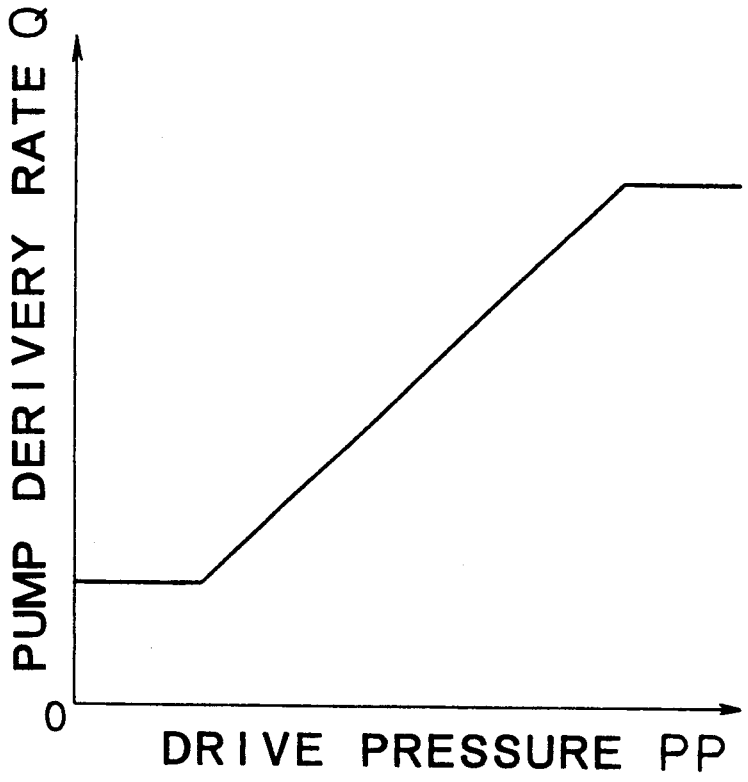
FIG. 8 is a graph showing the relationship between a drive pressure acting on a regulator showing in FIG. 1 and a pump delivery rate controlled by the drive pressure.

As shown in FIG. 7, the solenoid valve 10 has such a characteristic as to output the drive pressure PP which increases in proportion to an increase of the drive signal ED outputted from the controller 9. Also, as shown in FIG. 8, a control function of the displacement volume varying member 30 effected by the first servo valve of the regulator 2 has such a characteristic that the delivery rate Q of the hydraulic pump 1 is increased in proportion to an increase of the drive pressure PP outputted from the solenoid valve 10.

The first embodiment arranged as explained above operates as follows.

Figure 9:
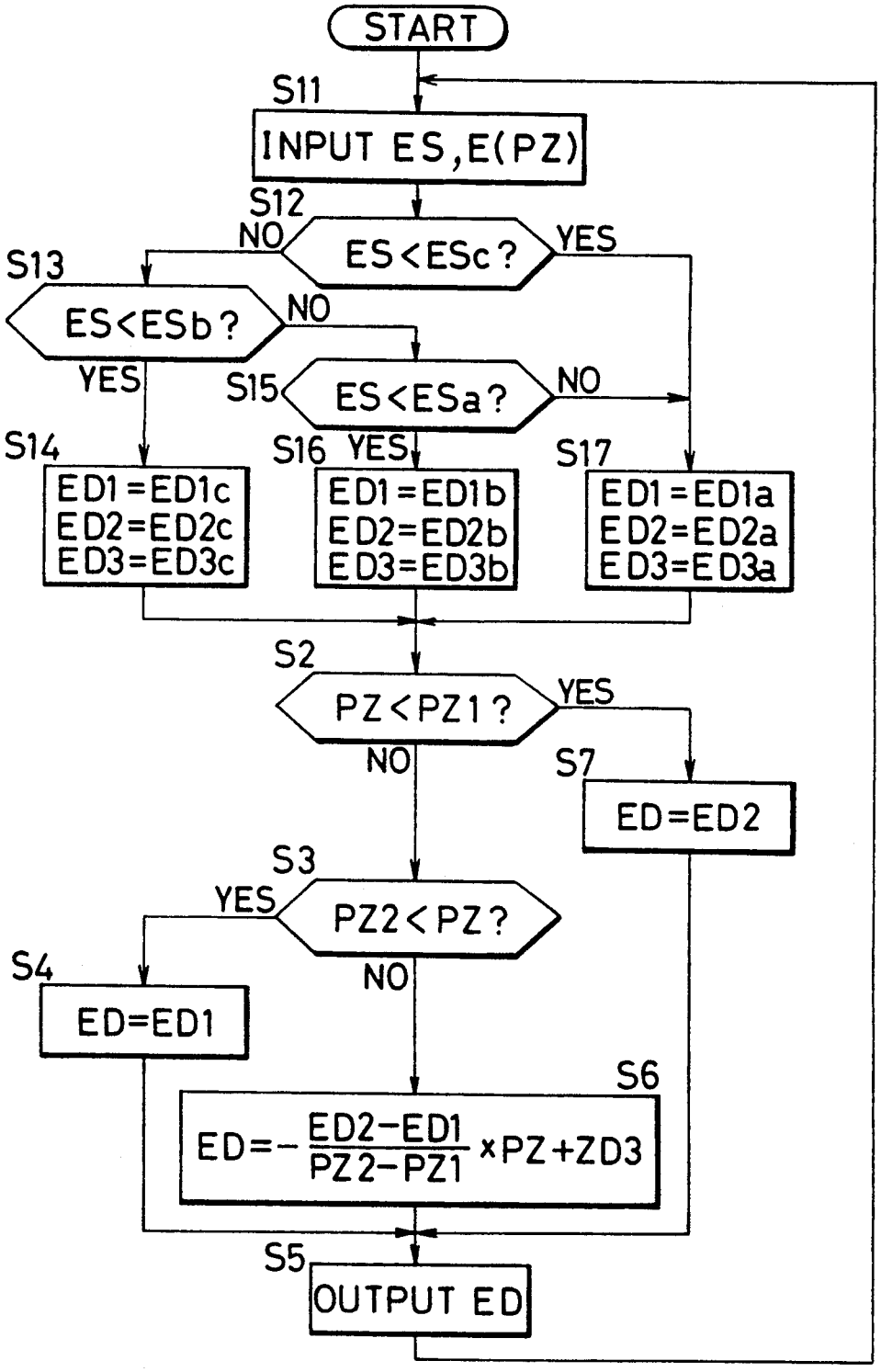
FIG. 9 is a flowchart showing a control program stored in the ROM shown in FIG. 5.

First, an operator prearranges the work to be performed and operates the selector 12 for setting the control characteristic of the directional control valve suitable for the intended work. Upon this operation, the selector 12 outputs the corresponding command signal ES to the controller 9. In the controller 9, as shown in FIG. 9, the command signal ES is inputted in a step S11 and a comparison is made in a step S12 as to whether or not the value of the command signal ES is smaller than a first setting value ESc stored in advance. If the value of the command signal ES is determined to be smaller than the first setting value ESc, then the control flow goes to a step S17 where a minimum value ED1 is set to the aforesaid first minimum value ED1a, a maximum value ED2 is set to the aforesaid first maximum value ED2a, and ED3 is set to the aforesaid ED3a. Thus, the first pump flow rate characteristic 40 shown in FIG. 6 is set as the pump flow rate characteristic. On the other hand, if a negative decision is resulted in the step S12, then the control flow goes to a step S13 where a comparison is made as to whether or not the value of the command signal ES is smaller than a second setting value ESb (>ESc) stored in advance. If the value of the command signal ES is determined to be smaller than the second setting value ESb, then the control flow goes to a step S14 where the minimum value ED1 is set to the aforeto the aforesaid third maximum value ED2c, and ED3 is set to the aforesaid ED3c. Thus, the third pump flow rate characteristic 42 shown in FIG. 6 is set as the pump flow rate characteristic. If a negative decision is resulted in the step S13, then the control flow goes to a step S15 where a comparison is made as to whether or not the value of the command signal ES is smaller than a third setting value ESa (>ESb) stored in advance. If the value of the command signal ES is determined to be smaller than the third setting value ESa, then the control flow goes to a step S16 where the minimum value ED1 is set to the aforesaid second minimum value ED1b, the maximum value ED2 is set to the aforesaid second maximum value ED2b, and ED3 is set to the aforesaid ED3b. Thus, the second pump flow rate characteristic 41 shown in FIG. 6 is set as the pump flow rate characteristic. If a negative decision is resulted in the step S15, then the control flow goes to a step S17 where the first pump flow rate characteristic 40 is set as mentioned above.

After the pump flow rate characteristic is set in this way, the delivery flow rate of the hydraulic pump 1 is controlled in accordance with the set pump flow rate characteristic.

More specifically, first, when no directional control valves 4 are operated as shown in FIG. 1, the flow rate of the hydraulic fluid passing through the center bypasses and the fixed restrictor 5 is maximized. Therefore, the pressure upstream of the fixed restrictor 5, i.e., the control pressure PZ, becomes high and this high control pressure PZ is detected by the pressure sensor 8, so that the electric signal E(PZ) of a large value corresponding to the high control pressure PZ is outputted to the controller 9. In the controller 9, as shown in FIG. 9, the electric signal E(PZ) is inputted in the step S11 and a comparison is made in a step S2 as to whether or not the value PZ of the electric signal E(PZ) is smaller than the setting value PZ1, shown in FIG. 6, stored in advance. Now, since the value PZ is sufficiently large, the above decision is not satisfied, followed by going to a step S3. In this step S3, a comparison is made as to whether or not the value PZ is larger than the setting value PZ2, shown in FIG. 6, stored in advance. Now, since the value PZ is sufficiently large, the above decision is satisfied, followed by going to a step S4. This step S4 performs processing to set the drive signal ED to the minimum value ED1 which has been set as mentioned above, followed by going to a step S5. This step S5 performs processing to output the drive signal ED (=ED1) to the solenoid valve 10. Depending upon the drive signal ED (=ED1), the solenoid valve 10 outputs the small drive pressure PP, as seen from FIG. 7, to the regulator 2. The regulator 2 is actuated with the drive pressure PP to control the tilting amount of the swash plate of the hydraulic pump 1 so that the delivery rate Q of the hydraulic pump 1 becomes a minimum flow rate as seen from FIG. 8.

Then, when the directional control valve 4A, for example, is shifted under the above condition, the flow rate through the center bypass is gradually reduced with the shifting operation, and the control pressure PZ upstream of the fixed restrictor 5, which pressure is detected by the pressure sensor 8, is also gradually reduced. This renders the above decision of the step S3 shown in FIG. 9 not satisfied, whereby the control flow goes to a step S6 from the step S3. In the step S6, the following calculation is performed:

$$ED = -\{(ED2-ED1)/(PZ2-PZ1)\}\cdot PZ+ED3$$

The drive signal ED obtained through that calculation corresponds to sloped portions of the characteristic lines 40, 41, 42 in FIG. 6. Specifically, the calculation of above Equation (1) is performed if the first pump flow rate characteristic 40 is selected, the calculation of above Equation (2) is performed if the second pump flow rate characteristic 41 is selected, and the calculation of above Equation (3) is performed if the third pump flow rate characteristic 42 is selected.

After the step S6, the control flow goes to the aforesaid step S5. The step S5 performs, as explained above, processing to output the drive signal ED to the solenoid valve 10. Here, the drive signal ED takes a value gradually increased. Accordingly, the solenoid valve 10 outputs, to the regulator 2, the drive pressure PP shown in FIG. 7 which is increased in proportion to the drive signal ED as explained above. The regulator 2 is actuated with that drive pressure PP to control the tilting amount of the swash plate of the hydraulic pump 1 so that the delivery rate Q of the hydraulic pump 1 becomes a maximum flow rate as seen from FIG. 8.

Then, when the directional control valve 4A is fully shifted and the control pressure PZ becomes smaller than the setting value PZ1 shown in FIG. 6, the above decision of the step S2 shown in FIG. 9 is satisfied, whereby the control flow goes to a step S7. This step S7 performs processing to set the drive signal ED to the maxmum value ED2 which has been set as mentioned above, followed by going to the step S5. This step S5 performs, as explained above, processing to output the drive signal ED (=ED2) to the solenoid valve 10. Depending upon the drive signal ED (=ED2), the solenoid valve 10 outputs the maxmum drive pressure PP, as seen from FIG. 7, to the regulator 2. The regulator 2 is actuated with the drive pressure PP to control the tilting amount of the swash plate of the hydraulic pump 1 so that the delivery rate Q of the hydraulic pump 1 becomes a maxmum flow rate as seen from FIG. 8.

Figure 10:
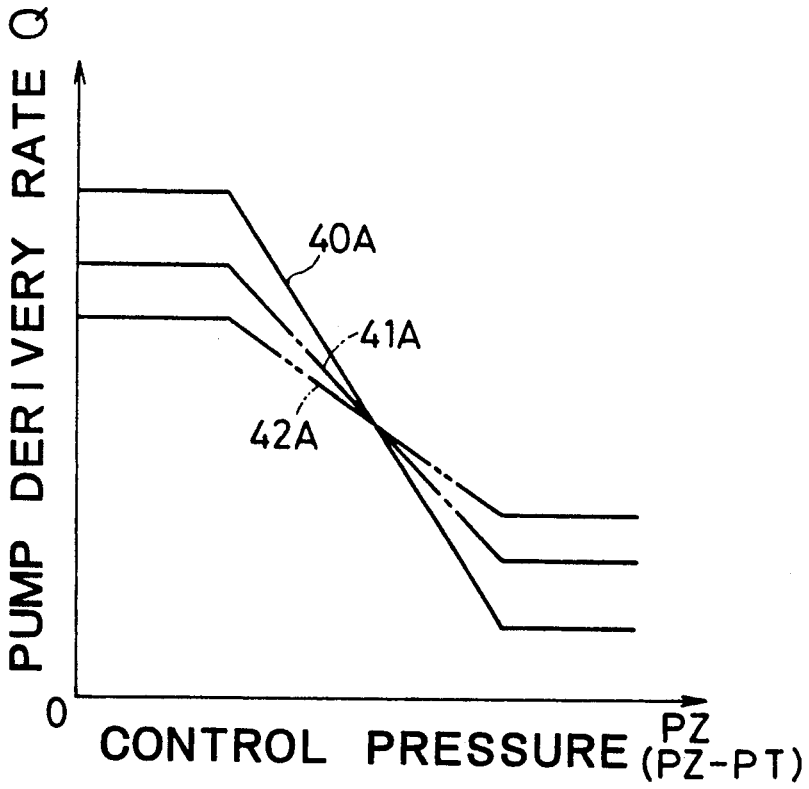
FIG. 10 is a graph showing the relationship between a control pressure for the hydraulic drive system shown in FIG. 1 and the pump delivery rate.

Through the foregoing control, the relationship between the control pressure PZ upstream of the fixed restrictor 5 and the delivery rate Q of the hydraulic pump 1 can be one of those relationships indicated by 40A, 41A, 42A shown in FIG. 10 corresponding to setting of any one of the above-mentioned first to third pump flow rate characteristics 40, 41, 42. In addition, the relationship between the stroke of the directional control valve 4A, for example, and the delivery rate Q of the hydraulic pump 1 can be one of those relationships indicated by 40B, 41B, 42B shown in FIG. 11 corresponding to setting of any one of the above-mentioned first to third pump flow rate characteristics 40, 41, 42.

As describe before, during normal operation in which the hydraulic fluid is supplied to the actuator 7 for driving it, by way of example, the actuator 7 is supplied with the hydraulic fluid at a flow rate resulted by subtracting, from the pump delivery rate Q, the flow rate of the hydraulic fluid flowing out through the variable restrictor 26 for bleeding-off, i.e., the flow rate through the center bypass. Assuming now that a load pressure of the actuator 7 is constant, the characteristic of the flow rate through the center bypass, which can flow out through the bleeding-off variable restrictor 26, with respect to the valve stroke is given as shown at 29A in FIG. 12 corresponding to an opening characteristic 29 shown in FIG. 3. In this case, therefore, the control characteristic of the directional control valve 4A with respect to the flow rate of the hydraulic fluid supplied to the actuator 7 is given by one of those shown at 40C, 41C, 42C in FIG. 12 corresponding to any of the pump flow rate characteristics 40B, 41B, 42B shown in FIG. 11. Stated otherwise, when the first pump flow rate characteristic 40 is selected by operation of the selector 12, there is obtained a characteristic 40C which is superior in rising of the metering property and can provide a large flow rate. Also, since the pump delivery rate has a small minimum value as indicated by a characteristic 40B at this time, the machine can be efficiently operated with less energy loss. When the selector 12 is operated to select the third pump flow rate characteristic 42, there is obtained a characteristic 42C which is superior in the metering property and can provide a small flow rate. Furthermore, when the selector 12 is operated to select the second pump flow rate characteristic 41, there is obtained a characteristic 41C which is medium in both the metering property and the maximum flow rate.

The foregoing has been described as operating the directional control valve 4A solely. When operating plural ones of the directional control valves at the same time, the flow rate through the center bypass is reduced as the total input amount of those plural directional control valves increases and, in response to this reduction in the flow rate through the center bypass, the control pressure produced upstream of the fixed restrictor 5 is also reduced. Therefore, the relationships of the pump delivery rate with respect to the total input amount of the plural directional control valves are similar to those shown in FIG. 11. As a result, the control characteristic similar to the above one can be obtained for each of the plural directional control valves.

Accordingly, by selecting the first pump flow rate characteristic 40, the work such as digging and loading which requires powerful operation can be efficiently performed with less energy loss. By selecting the third pump flow rate characteristic 42, the work such as craning which requires fine operation can be easily performed. By selecting the second pump flow rate characteristic 41, the work such as shaping which requires a medium level in both the metering property and the operating speed can be easily performed.

With this embodiment, as explained above, since the first to third pump flow rate characteristics 40, 41, 42 are preset in the ROM 9C of the controller 9, one of these characteristics is selected in response to the command signal ES outputted from the selector 9, and the delivery rate of the hydraulic pump 1 is controlled using the selected pump flow rate characteristic, the flow rate characteristic of the hydraulic pump 1 can be optionally changed to vary the control characteristics of the directional control valves 4A to 4D. It is thus possible to vary the control characteristics of the associated directional control valves dependent upon the intended work schedule and ensure good operating efficiency for plural types of work different from each other.

Additionally, since the plural pump flow rate characteristics 40 to 42 preset in the ROM of the controller 9 comprise three groups of setting values which respectively include the first minimum value ED1a and the first maximum value ED2a, the second minimum value ED1b and the second maximum value ED2b, and the third minimum value ED1c and the third maximum value ED2c, the flow rate characteristic of the hydraulic pump 1 can be optionally set to realize the desired control characteristic of the directional control valve by selecting one of those groups with the command ES signal from select means.

Figure 13:
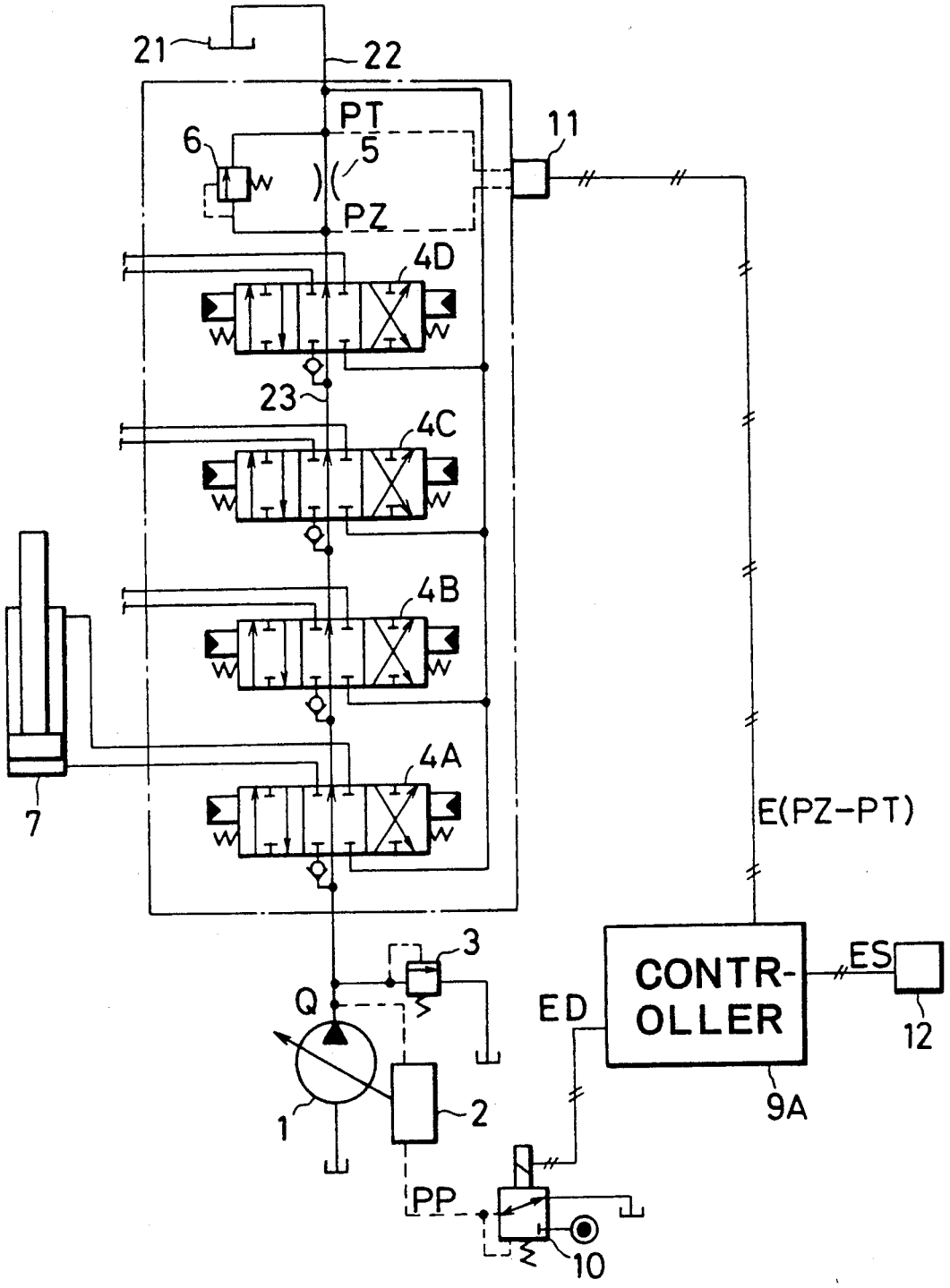
FIG. 13 is a circuit diagram showing a hydraulic drive system according to a second embodiment of the present invention.

A second embodiment of the present invention will be described below with reference to FIG. 13. In FIG. 13, identical members to those shown in FIG. 1 are denoted by the same reference numerals.

This embodiment includes, as the pressure sensor, a differential pressure sensor 11 which detects a differential pressure PZ−PT between the pressure PZ upstream of the fixed restrictor 5 and the pressure PT downstream thereof, and then outputs an electric signal E(PZ−PT) to a controller 9A. In the controller 9A, the function relationships shown in FIG. 6 are preset as a plurality of pump flow rate characteristics each of which defines the relationship between the electric signal E(PZ−PT) outputted from the differential pressure sensor 11 and the delivery rate Q of the hydraulic pump 1. The remaining arrangement is identical to the first embodiment shown in FIG. 1.

Figure 11:
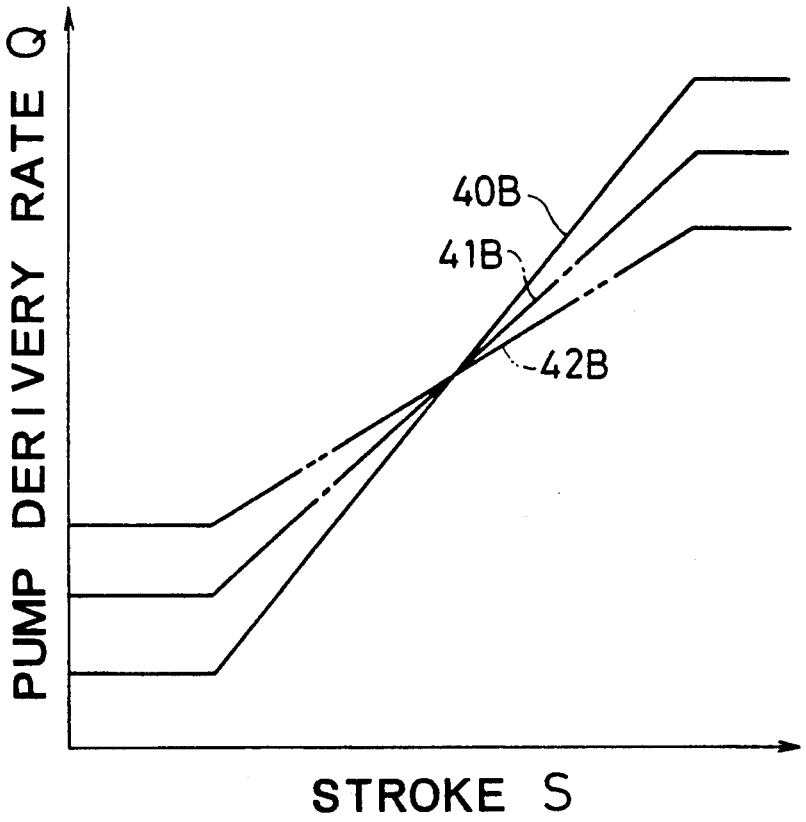
FIG. 11 is a graph showing the relationship of the pump delivery rate with respect to the stroke of the directional control valve shown in FIG. 1.
Figure 12:
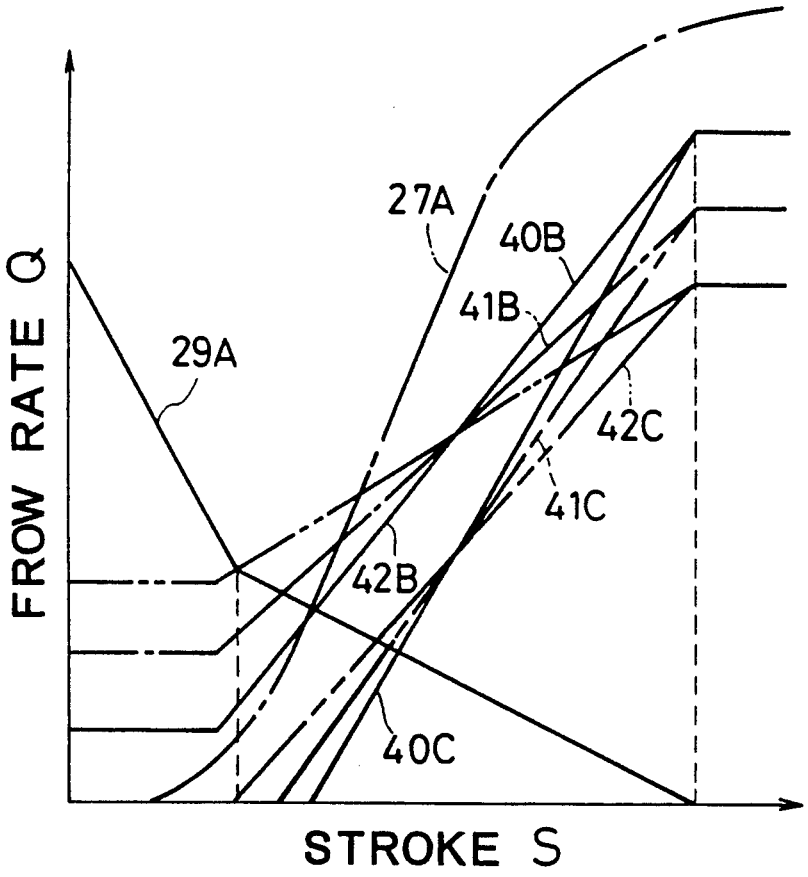
FIG. 12 is a graph showing control characteristics of the directional control valve shown in FIG. 1 with respect to the flow rate of a hydraulic fluid supplied to an actuator.

In the second embodiment of the above arrangement, the relationship between the differential pressure PZ−PT across the fixed restrictor 5 and the delivery rate Q of the hydraulic pump 1 is given as shown in FIG. 10 like the first embodiment. Therefore, the relationship between the stroke of the directional control valve 4A, for example, and the delivery rate Q of the hydraulic pump 1 is given as shown in FIG. 11 like the first embodiment, resulting in an operating effect similarly to that in the first embodiment. Additionally, in the second embodiment, the differential pressure across the fixed restrictor 5 is detected as the control pressure and this differential pressure will not be influenced even if the pressure in the low-pressure circuit 22, representing a back pressure of the fixed restrictor 5, is fluctuated. Accordingly, influences by the back pressure of the fixed restrictor 5 can be eliminated, which leads to an advantage of improving control accuracy.

It is to be noted that while the fixed restrictor 5 is provided as means for producing the control pressure in the above embodiments, a relief valve having an override characteristic may be provided in place of the fixed restrictor 5.

Also, while the regulator 2 is driven via the solenoid valve 10 in the above embodiments, the drive signal ED outputted from the controller 9 or 9A may be directly applied to the regulator for driving it.

INDUSTRIAL APPLICABILITY

Since the hydraulic drive system for construction machines of the present invention is arranged as described above, the control characteristic of the directional control valve can be varied by changing the flow rate characteristic of the hydraulic pump, thus making it possible to vary the control characteristic of the directional control valve dependent upon the intended work schedule and ensure good operating efficiency for plural types of work different from each other.

What is claimed is:

1. A hydraulic drive system for a construction machine comprising a hydraulic pump (1) of variable displacement type, a pump regulator (2) for controlling a delivery rate of said hydraulic pump, a plurality of hydraulic actuators (7) driven by a hydraulic fluid supplied from said hydraulic pump, a plurality of directional control valves (4A–4D) for controlling respective flows of the hydraulic fluid supplied from said hydraulic pump to said plural hydraulic actuators, a low-pressure circuit (22), a center bypass line (23) for connecting in series center bypasses of said plural directional control valves to said low-pressure circuit, a plurality of bleeding-off restrictor means (26) disposed in said center bypass line and having their openings variable in accordance with the associated directional control valves, respectively, flow resistive means (5) disposed in said center bypass line for producing a control pressure (PZ), and pressure sensor means (8) for detecting said control pressure and outputting a corresponding electric signal (E), wherein a drive signal (ED) of said pump regulator is given dependent upon the electric signal outputted from said pressure sensor means and said pump regulator is driven with said drive signal, said hydraulic drive system further comprising:

(a) memory means (**9*c*) for storing a plurality of preset pump flow rate characteristics (40, 41, 42) that define relationships between a value of the electric signal (E) outputted from said pressure sensor means (8) and a delivery rate (Q) of said hydraulic pump (1**);

(b) selector means (12) for outputting a command signal (ES) to select one of the plural pump flow rate characteristics (40, 41, 42) preset in said memory means; and (c) arithmetic means (**9*b*) for determining the delivery rate (Q) corresponding to the value of the electric signal (E) outputted from said pressure sensor means (8**) based on the pump flow rate characteristic selected in response to said command signal (ES), and outputting, as said drive signal (ED), a signal corresponding to the determined delivery rate.

2. A hydraulic drive system for a construction machine according to claim 1, wherein said memory means (**9*c*) and said arithmetic means (9*b*) are constituted by a microcomputer, and said selector means is a manual selector (12**) for outputting said command signal (ES) to said microcomputer.

3. A hydraulic drive system for a construction machine according to claim 1, wherein said pressure sensor means is means (8) for detecting a pressure upstream of said flow resistive means (5).

4. A hydraulic drive system for a construction machine according to claim 1, wherein said pressure sensor means is means (12) for detecting a differential pressure across said flow resistive means (5).

5. A hydraulic drive system for a construction machine according to claim 1, wherein the plural pump flow rate characteristics (40, 41, 42) preset in said memory means (9*c*) include plural groups of maximum and minimum setting values (ED1a, ED2a; ED1b, ED2b; ED1c, ED2c), and one of these plural groups of setting values is selected in response to the command signal (ES) outputted from said selector means (12).

* * * * *